United States Patent [19]

Papaluca

[11] 4,077,182

[45] Mar. 7, 1978

[54] LIQUID FILL APPARATUS

[75] Inventor: Vincent Papaluca, Melton, Australia

[73] Assignee: ACI Operations Pty, Ltd., Melbourne, Australia

[21] Appl. No.: 744,321

[22] Filed: Nov. 23, 1976

[30] Foreign Application Priority Data

Dec. 1, 1975 Australia ..... 4125/75

[51] Int. Cl.[2] ..... B65B 31/04; B67B 7/16

[52] U.S. Cl. ..... 53/109; 53/281; 53/381 A

[58] Field of Search ..... 53/109, 281, 381 A, 53/37

[56] References Cited

U.S. PATENT DOCUMENTS

| | | | |
|---|---|---|---|
| 2,145,941 | 2/1939 | Maxfield | 53/112 A X |
| 3,299,606 | 1/1967 | Weikert | 53/381 A X |
| 3,377,775 | 4/1968 | Mattimoe et al. | 53/381 A |
| 3,447,281 | 6/1969 | Buford et al. | 53/381 A X |

*Primary Examiner*—Travis S. McGehee
*Attorney, Agent, or Firm*—Murray & Whisenhunt

[57] ABSTRACT

An apparatus for liquid filling a flexible collapsible container in the form of a plastic pouch for packaging wine is disclosed. The pouch has a pouring spout and a closure for the spout. The apparatus comprises a base for firmly holding the spout and a frame movable relative to the spout. The frame supports a closure removal head and a liquid fill head, either of which may be brought into engagement with the spout upon movement of the frame. The closure removal head is adapted to grip the closure and, upon movement of the frame, remove the closure from the spout. The liquid fill head is adapted to apply a vacuum pump output to the spout to evacuate the pouch, apply liquid to fill the pouch and supply nitrogen to purge contaminants from the pouch. All operations are performed without the need to move the pouch.

7 Claims, 2 Drawing Figures

LIQUID FILL APPARATUS

This invention relates to an apparatus for rapidly filling containers with liquid and more particularly to an apparatus for rapidly filling flexible, collapsible containers or receptacles in the form of plastic pouches having a filling and pouring spout secured to the pouch in communication with an access opening of the pouch. Such containers are suitable for packaging non-fortified wines which must be stored in oxygen free conditions to avoid contamination. The filled pouch is usually accommodated in a paperboard carton.

An example of a spout/closure system which is suitable for use with the apparatus of the invention is the Fattori system described in Australian Pat. No. 446,218.

In order to fill a pouch of the above kind, it is necessary to perform the operations of removing a closure member from the spout, filling the pouch with the liquid to be packaged, in the case of non-fortified wines purging oxygen and other contaminants from the pouch and replacing the closure member on the spout. In view of the flexibility of the pouch, it becomes difficult to handle once filled and therefore it is desirable to reduce the number of handling operations to a minimum.

Accordingly, it is an object of the present invention to provide an apparatus for filling flexible collapsible containers with liquid whereby the spout remains in the one position at least during the operations of removing the closure therefrom, filling the container with liquid, and replacing the closure on the spout.

Figure 2:
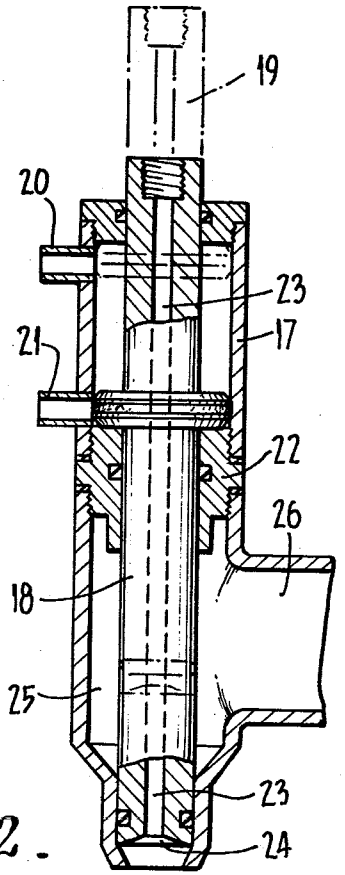
Figure 1:
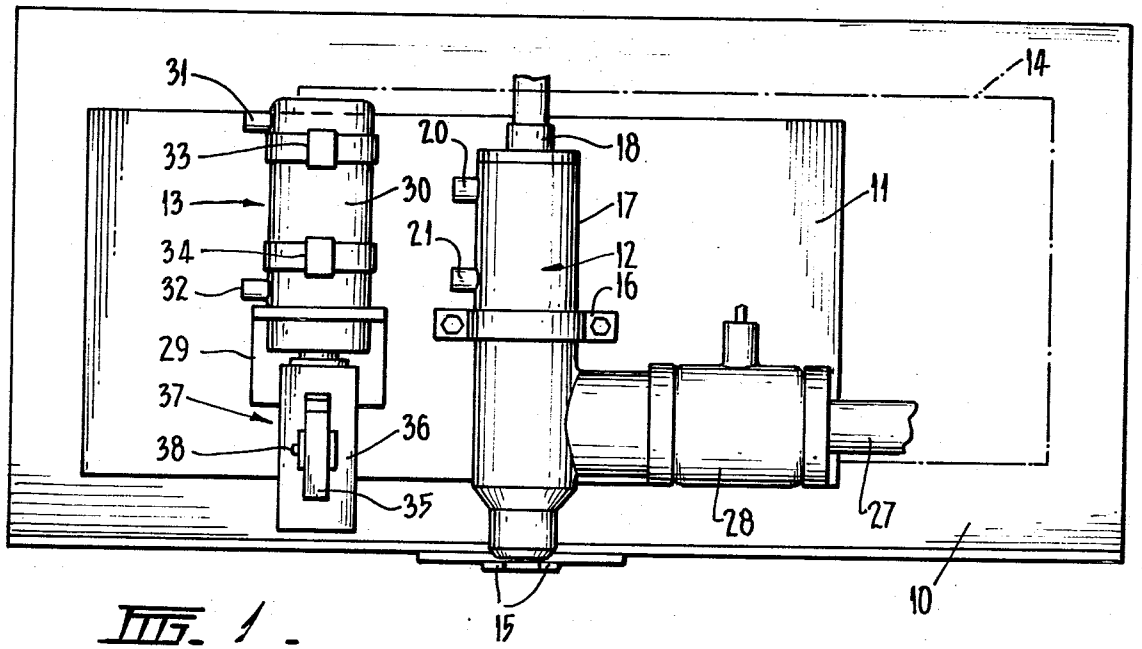

In order that the invention may be more readily understood, one particular embodiment will now be described with reference to the accompanying drawings wherein:

FIG. 1 is a front elevation of an apparatus in accordance with the invention, and FIG. 2 is a sectional front elevation of the fill head of the apparatus of FIG. 1.

Referring to the drawings the apparatus is shown to consist essentially of a fixed base 10 on which is arranged a mounting plate 11 for supporting a filling head 12 and a closure removal head 13. An arrangement of pneumatic cylinders (not shown) is mounted behind the mounting plate 11 shown in FIG. 1 and is adapted to move the mounting plate 11 relative to the base 10 back and forth between two positions shown respectively by the full lines and the broken lines 14 for purposes to become apparent.

The fixed base 10 is provided with a pair of forked fingers 15 for firmly holding the spout (not shown) of a collapsible bag located underneath the mounting plate 11. The two positions of the mounting plate 11 correspond to either the fill head 12 or the closure removal head 13 being positioned directly above the fingers 15.

The fill head 12 is secured to the mounting plate 11 by means of a mounting bracket 16. The fill head 12 consists essentially of an outer cylindrical casing 17 (FIG. 2.) accommodating a piston or plunger 18 arranged for longitudinal sliding movement therein from the illustrated position to the position indicated by the broken lines 19. Movement of the piston 18 is achieved pneumatically by air pressure supplied either through port 20 to cause the piston to move downwardly or through the port 21 to cause the piston to move upwardly. A guide member 22 is located within the cylinder 17 to act as a guide for the piston 18 and as a seal between the upper and lower chambers of the fill head.

The piston 18 has a longitudinal bore 23 extending therethrough for the purpose of providing nitrogen gas or a vacuum through the bore 23 from the top to a nozzle 24 located at the bottom end of the cylinder 17. A pressure line (not shown) is connected to the top of the piston 18 to provide either a nitrogen source or a vacuum pump to the bore 23 as required.

The piston is arranged such that up and down movement thereof opens and closes, respectively, the nozzle 24 from communication with a liquid supply chamber 25. The chamber 25 receives liquid via port 26 from supply line 27 (FIG. 1). A flow meter 28 is located in the supply line 27 to sense the amount of liquid flowing through supply line 27 and to provide a signal whereby the movement of the piston 18 can be controlled to allow accurate quantities of liquid to be dispensed through the nozzle 24. In the position of the mounting plate 11 shown in FIG. 1, the nozzle 24 is arranged in fluid-tight communication with a container spout held in the fingers 15.

The closure removal head 13 is secured to a metal plate 29 which is in turn secured to the mounting plate 11. Actuation of the removal head to cause operation of a closure gripper lever 35 is carried out by a pneumatic piston (not shown) acting within cylinder 30 along the same lines as the piston 18 of the filling head 12. Hence the ports 31 and 32 provide air supply communication with an inner chamber of the cylinder 30. Reed switches 33 and 34 sense the position of the piston within the cylinder 30 and provide electrical signals to initiate the appropriate sequence of movements of the apparatus.

A closure gripper assembly 37 is provided at the bottom of the closure removal head. The assembly 37 comprises a base part 36 fixed to the head 13 and the aforementioned closure gripper lever 35 which is mounted on the base 36 by means of fixed hinge pin 38. Actuation of the piston (not shown) within cylinder 30 causes rocking movement of the lever 35 whereby the bottom end of the lever moves closer to the part 36. Thus, with the mounting plate 11 in the position shown by broken lines 14, the gripper assembly 37 is adjacent the closure of a spout held between fingers 15 and actuation of the piston in cylinder 30 causes the closure to be gripped between the part 36 and the lever 35 adjacent the bottom thereof. The plate 11 may then be moved pneumatically in an upward direction from that shown by the broken lines whereby the closure is removed from the spout.

The sequence of movements of one full cycle of the fill head and removal head assembly after the closured spout of a collapsible pouch has been placed in the fingers 15 is set out in the following steps:

1. The mounting plate 11 moves to the position shown by the broken lines 14 thereby positioning the bottom of the closure removal head over the closured spout held in the fingers 15;

2. The pneumatic piston on the closure head 13 becomes activated to cause the lever arm 35 to grip the closure;

3. The mounting plate moves upwardly, sideways and downwardly, thereby removing the closure from the spout and positioning the nozzle of the fill head in the spout according to the configuration illustrated in unbroken lines in FIG. 1;

4. Vacuum is applied through the bore 23 of the fill head thereby evacuating the bag whilst the piston 18 in the fill head is in the downward position to prevent flow of liquid through the nozzle 24;

5. The piston 18 in the fill head 12 is raised and a metered quantity of liquid such as wine is dispensed through the fill head nozzle 24 and into the bag;

6. The piston in the fill head 12 is lowered and a stream of nitrogen is directed through the nozzle to purge the filled bag of air;

7. The mounting plate 11 moves upwardly sideways and downwardly to the position shown by the dotted lines 14 thereby positioning the closure back on the spout;

8. The removal head 13 releases its grip on the closure and the whole mounting plate moves back to a "START" position (not shown) wherein neither head is adjacent the fingers 15.

From the above description, it should be apparent that the invention provides a relatively simple apparatus which enables rapid filling of collapsible containers without the necessity for moving the container to different positions between the various filling operations. After filling and closing the container, it may be packaged in a paperboard carton such that the pouring spout may be withdrawn from the carton through an aperture formed by tearing the carton along the perforated line.

We claim:

1. Apparatus for liquid filling a flexible, collapsible container, said container having a pouring spout and a closure for said spout, said apparatus comprising:

holding means for holding said spout in a fixed location during the steps of closure removal, evacuation of the container, filling of the container with liquid, inert gas purging of the container, and closure replacement on said spout;

closure removal means for gripping by pinching and removing said closure and for replacing same;

nozzle means for subjecting the interior of said container to a vacuum through said spout, passing liquid into said container through said spout, and passing a purging stream of inert gas into said container through said spout;

frame member means having said closure removal means and said nozzle means mounted thereon and movable relative to said fixed location from a first position wherein said closure is removed from said container by said closure removal means to a second position wherein the container is evacuated, liquid is passed into said container, and the container is purged with inert gas through said spout, and back to said first position wherein said closure is replaced on said spout.

2. Apparatus of claim 1, wherein said nozzle means has a lower end with a single port therein, said lower end forming an air-tight seal with said pouring spout when said frame member is in said second position.

3. Apparatus of claim 2, wherein said apparatus includes means for supplying liquid to said nozzle means and means for selectively supplying nitrogen gas or a source of vacuum to said nozzle means, said means cooperating to permit said container to be evacuated, filled with liquid and purged with nitrogen without removing said nozzle means from said pouring spout.

4. Apparatus of claim 3, wherein said closure removal means includes a pivotal lever movable from a first lever position to a second lever position, piston means for moving said lever between said lever positions, and a backing member means cooperating with said lever to permit a closure to freely fit between said backing member means and said lever when said lever is in said first lever position, and to firmly grip said closure thereinbetween when said lever is in said second lever position to remove and replace said closure on said pouring spout.

5. Apparatus of claim 4, wherein said nozzle means includes a substantially cylindrical body, a filling nozzle at the lower end of said body, a liquid supply chamber communicable with said filling nozzle, a piston member means located within said body for slidable movement between a lower position wherein said piston closes said filling nozzle from communication with said liquid supply chamber and an upper position wherein liquid may flow from said liquid supply chamber to said nozzle, said piston having a bore extending substantially vertically therethrough and being communicable at one end with said filling nozzle and at the other end selectively with a vacuum source or a nitrogen supply.

6. Apparatus of claim 5, wherein the parts of said apparatus cooperate to fill a container with liquid by causing, in sequence:

a. the frame member means to move to said first position;
b. said closure removal means to grip said closure;
c. said frame member means and closure removal means mounted thereon to move upwardly away from said spout to remove said closure;
d. said frame member means to move to said second position;
e. said container to be evacuated, filled with liquid, and purged with nitrogen;
f. said frame member means to move to said first position to replace said closure;
g. said closure removal means to release said closure; and
h. said frame member means to return to a start position.

7. Apparatus for liquid filling a flexible, collapsible container, said container having a pouring spout and a closure for said spout, said apparatus comprising:

holding means for holding said pouring spout in a fixed location during the steps of closure removal, filling of the container with liquid, and closure replacement on said spout;

closure removal means for gripping and removing said closure and for replacing said closure;

liquid nozzle means for passing liquid into said container through said pouring spout;

frame member means having said closure removal means and said liquid nozzle means mounted thereon, said frame member means movable relative to said fixed location from a first position wherein said closure is removed from said container by said closure removal means and a second position wherein liquid is passed by said liquid nozzle means through said pouring spout into the container with the closure therefor removed and further movable back to said first first position wherein said closure is replaced on said pouring spout of the liquid-containing container by said closure removal means, said closure removal means including a pivotable lever movable from a first lever position to a second lever position, piston means for moving said lever between said lever positions, and a backing member means cooperating with said lever to permit a closure to freely fit thereinbetween when said lever is in said first lever position, and to firmly grip said closure thereinbetween when said lever is in said second lever position to remove and replace said closure on said spout.

* * * * *